US008262200B2

(12) United States Patent
Okamura

(10) Patent No.: US 8,262,200 B2
(45) Date of Patent: Sep. 11, 2012

(54) NON-WETTING COATING ON A FLUID EJECTOR

(75) Inventor: Yoshimasa Okamura, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 400 days.

(21) Appl. No.: 12/560,376

(22) Filed: Sep. 15, 2009

(65) Prior Publication Data

US 2011/0063369 A1 Mar. 17, 2011

(51) Int. Cl.
*B41J 2/14* (2006.01)
*B41J 2/135* (2006.01)

(52) U.S. Cl. ..... 347/47; 347/44

(58) Field of Classification Search ..... 347/44, 347/45, 47, 63, 64, 65
See application file for complete search history.

(56) References Cited

U.S. PATENT DOCUMENTS

| | | | | |
|---|---|---|---|---|
| 5,121,134 | A | 6/1992 | Albinson et al. | |
| 5,595,785 | A | 1/1997 | Hindagolla et al. | |
| 5,606,352 | A | 2/1997 | Yamakawa et al. | |
| 5,781,213 | A | 7/1998 | Ujita et al. | |
| 5,812,158 | A * | 9/1998 | Murthy et al. | 347/45 |
| 5,910,372 | A | 6/1999 | Griffin et al. | |
| 5,959,643 | A | 9/1999 | Temple et al. | |
| 6,283,578 | B1 | 9/2001 | Popall et al. | |
| 6,312,103 | B1 | 11/2001 | Haluzak | |
| 6,325,490 | B1 | 12/2001 | Yang et al. | |
| 6,364,456 | B1 | 4/2002 | Yang et al. | |
| 6,416,159 | B1 | 7/2002 | Floyd et al. | |
| 6,428,142 | B1 | 8/2002 | Silverbrook et al. | |
| 6,472,332 | B1 | 10/2002 | Gooray et al. | |
| 6,488,357 | B2 | 12/2002 | Skinner et al. | |
| 6,561,624 | B1 | 5/2003 | Shozo et al. | |
| 6,676,244 | B2 | 1/2004 | Kwon et al. | |
| 6,827,973 | B2 | 12/2004 | Nagashima | |
| 6,938,986 | B2 | 9/2005 | Macler et al. | |
| 6,972,261 | B2 | 12/2005 | Wong et al. | |
| 7,104,632 | B2 | 9/2006 | Song et al. | |
| 7,347,532 | B2 | 3/2008 | Chen et al. | |
| 7,622,048 | B2 | 11/2009 | Birkmeyer et al. | |
| 2003/0030697 | A1 | 2/2003 | Kwon et al. | |
| 2003/0042545 | A1 | 3/2003 | Voutsas et al. | |
| 2003/0197758 | A1 | 10/2003 | Sasaki et al. | |
| 2004/0002225 | A1 | 1/2004 | Wong et al. | |

(Continued)

FOREIGN PATENT DOCUMENTS

| | | | |
|---|---|---|---|
| EP | 1157842 | A1 | 11/2001 |
| EP | 1375154 | A2 | 1/2004 |
| EP | 1568500 | | 8/2005 |
| JP | 9085956 | | 3/1997 |
| JP | 10235858 | | 9/1998 |

(Continued)

OTHER PUBLICATIONS

Bunker et al., "The Impact of Solution Agglomeration on the Deposition of Self-Assembled Monolayers," Sandia National Laboratories, Received Apr. 4, 2000, Published on the Web Aug. 26, 2000, pp. 7742-7751.

(Continued)

*Primary Examiner* — Kristal Feggins
(74) *Attorney, Agent, or Firm* — Fish & Richardson P.C.

(57) ABSTRACT

A method of forming a non-wetting coating on a fluid ejector includes applying an oxygen plasma to a substrate to form an outer portion of the substrate having a density that is greater than a density of an interior portion of the substrate and depositing a non-wetting coating on an exterior surface of the outer portion. The outer portion is less than 80 Å thick.

19 Claims, 4 Drawing Sheets

U.S. PATENT DOCUMENTS

| | | | |
|---|---|---|---|
| 2004/0125169 | A1 | 7/2004 | Nakagawa et al. |
| 2005/0046663 | A1 | 3/2005 | Silverbrook |
| 2006/0057851 | A1 | 3/2006 | Wong et al. |
| 2007/0030306 | A1 | 2/2007 | Okamura et al. |
| 2008/0136866 | A1 | 6/2008 | Okamura et al. |
| 2008/0150998 | A1 | 6/2008 | Okamura |

FOREIGN PATENT DOCUMENTS

| | | | |
|---|---|---|---|
| WO | 03/013863 | A1 | 2/2003 |
| WO | 2005/007411 | | 1/2005 |
| WO | 2005/007413 | | 1/2005 |
| WO | 2005/037558 | A1 | 4/2005 |
| WO | 2007/005857 | | 1/2007 |
| WO | 2010/051272 | | 5/2010 |

OTHER PUBLICATIONS

Applied MicroStructures, Inc., "Common Precursors Used in MEMS", 2004, pp. 1-2.

Ashurst, et al., "Vapor Phase Anti-Stiction Coatings for MEMS", IEEE Transactions on Device and Materials Reliability, vol. 3, No. 4, Dec. 2003, pp. 173-178.

Ashurst, et al., "Dichlorodimethylsilane as an Anti-Stiction Monolayer for MEMS: A Comparison to the Octadecyltrichlosilane Self-Assembled Monolayer", Journal of Microelectromechanical Systems, vol. 10, No. 1, Mar. 2001, pp. 41-49.

Kobrin, et al., "Molecular Vapor Deposition—An Improved Vapor-Phase Deposition Technique of Molecular Coatings for MEMS Devices", SEMI® Technical Symposium: Innovations in Semiconductor Manufacturing, Semicon West 2004, pp. 1-4.

International Search Report and Written Opinion, mailed May 15, 2008, International Application Serial No. PCT/US2007/086165, 11 pgs.

International Search Report and Written Opinion, mailed Jan. 4, 2010, International Application Serial No. PCT/US2009/062194, 11 pgs.

* cited by examiner

NON-WETTING COATING ON A FLUID EJECTOR

TECHNICAL FIELD

This disclosure relates generally to coatings on fluid ejectors.

BACKGROUND

A fluid ejector (e.g., an ink jet printhead) typically has an interior surface, an orifice through which fluid is ejected, and an exterior surface. When fluid is ejected from the orifice, the fluid can accumulate on the exterior surface of the fluid ejector. When fluid accumulates on the exterior surface adjacent to the orifice, further fluid ejected from the orifice can be diverted from an intended path of travel or blocked entirely by interaction with the accumulated fluid (e.g., due to surface tension). Some materials from which fluid ejectors are fabricated (e.g., silicon) are hydrophilic, which typically exacerbates the problem of accumulation when fluids are ejected.

Non-wetting coatings such as Teflon® and fluorocarbon polymers can be used to coat surfaces. However, Teflon® and fluorocarbon polymers typically are soft and are not durable coatings. These coatings also can be expensive and difficult to pattern.

SUMMARY

In general, in one aspect, a method of forming a non-wetting coating on a fluid ejector includes applying an oxygen plasma to a substrate to form an outer portion of the substrate having a density that is greater than a density of an interior portion of the substrate and depositing a non-wetting coating on an exterior surface of the outer portion. The outer portion is less than 80 Å thick.

This and other embodiments may optionally include one or more of the following features. The density of the outer portion can be at least 2.5 g/cm$^3$. The density of the outer portion can be approximately 2.6 g/cm$^3$. The density of the inner portion can be between 2.0 g/cm$^3$ and 2.5 g/cm$^3$. The non-wetting coating can be formed from a precursor vapor that includes at least one of tridecafluoro-1,1,2,2-tetrahydrooctyltrichlorosilane (FOTS) or 1H,1H,2H,2H-perfluorodecyltrichlorosilane (FDTS). The non-wetting coating can be a self-assembled monolayer. The non-wetting coating can be between 5 Å and 30 Å thick. The non-wetting coating can be between 10 Å and 20 Å thick. The non-wetting coating can be a molecular aggregation. The non-wetting coating can be between 10 Å and 1,000 Å thick. The plasma can be applied at a pressure of less than 1 Torr. The oxygen plasma can be applied for 5 to 60 minutes. The oxygen plasma can be applied using an anode coupling plasma tool. The non-wetting coating can be applied using chemical vapor deposition. The method can further include applying the oxygen plasma to an interior surface of a fluid path formed in the substrate and depositing the non-wetting coating on the interior surface. The method can further include removing the non-wetting coating from the interior surface. The method can further include masking the exterior surface while removing the non-wetting coating from the interior surface.

In general, in one aspect, a fluid ejector includes a substrate and a non-wetting coating. The substrate has an exterior surface and an interior surface defining a fluid flow path to an orifice in the exterior surface. The substrate has an inner portion and an outer portion with the exterior surface. The inner portion has a first density and the outer portion has a second density greater than the first density. The outer portion is less than 80 Å thick. The non-wetting coating is adjacent to at least a portion of the exterior surface.

This and other embodiments may optionally include one or more of the following features. The inner portion can consist essentially of silicon. The second density can be at least 2.5 g/cm$^3$. The second density is approximately 2.6 g/cm$^3$. The first density can be between 2.0 g/cm$^3$ and 2.5 g/cm$^3$. The non-wetting coating can be formed from a precursor vapor that includes at least one of tridecafluoro-1,1,2,2-tetrahydrooctyltrichlorosilane (FOTS) or 1H,1H,2H,2H-perfluorodecyltrichlorosilane (FDTS). The non-wetting coating can be a self-assembled monolayer. The non-wetting coating can be between 5 Å and 30 Å thick. The non-wetting coating can be between 10 Å and 20 Å thick. The non-wetting coating can be a molecular aggregation. The non-wetting coating can be between 10 Å and 1,000 Å thick.

Certain implementations may have one or more of the following advantages. By bonding the non-wetting coating directly to the silicon substrate, an adhesion layer between the non-wetting coating and the nozzle layer is not required. Not having an adhesion layer saves both manufacturing and material costs. Further, because the adhesion layer can be susceptible to erosion by aggressive inks, bonding the non-wetting coating directly to the silicon layer reduces the risk of delamination of the non-wetting coating from the nozzle layer that can occur if the adhesion layer is eroded.

The details of one or more embodiments are set forth in the accompanying drawings and the description below. Other features, objects, and advantages of the invention will be apparent from the description, drawings, and claims.

DESCRIPTION OF DRAWINGS

Like reference symbols in the various drawings indicate like elements.

DETAILED DESCRIPTION

Figure 1A:
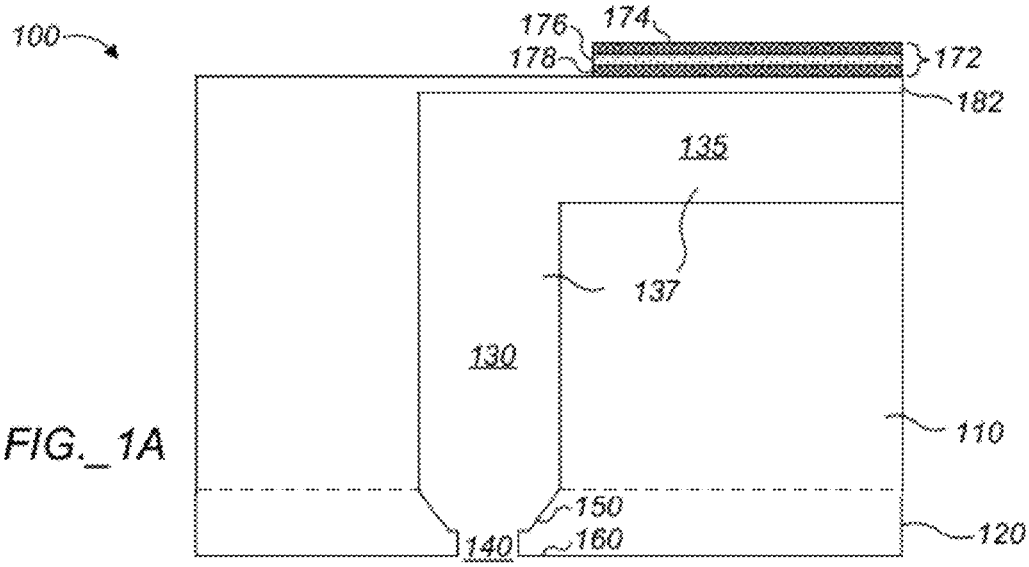
FIG. 1A is a cross-sectional view of an implementation of an uncoated fluid ejector.

FIG. 1A is a cross-sectional view of an uncoated fluid ejector 100 (e.g., an ink jet printhead nozzle), aspects of which not discussed herein can be implemented as described in U.S. Patent Publication No. 2008-0020573, the contents of which are hereby incorporated by reference.

The uncoated fluid ejector 100 includes a flow-path module 110 having a plurality of fluid paths therein and a nozzle layer 120, both of which can be made of silicon (e.g., single crystal silicon). In one implementation, the uncoated fluid ejector 100 is a single unit, and the flow-path module 110 and the nozzle layer 120 are not separate pieces. The uncoated fluid ejector 100 includes an inner surface 150 along the fluid path 137 and an outer surface 160. A membrane layer 182 is positioned above a pumping chamber 135. The flow-path module 110, nozzle layer 120 and membrane layer 182 provide a substrate on which the non-wetting coating can be deposited.

An actuator 172 pressurizes fluid (e.g., an ink, for example, a water-based ink) in the pumping chamber 135 and the fluid flows through a descender 130 and is ejected through an orifice 140 in the nozzle layer 120. The actuator 172 can include a piezoelectric layer 176, a lower electrode 178 (e.g., a ground electrode), and an upper electrode 174 (e.g., a drive electrode). The membrane layer 182 and the actuator 172 are not shown in the following figures, but can be present. Other configurations of flow paths 137 and actuators can alternatively be used with the coatings and techniques described herein.

Figure 1B:
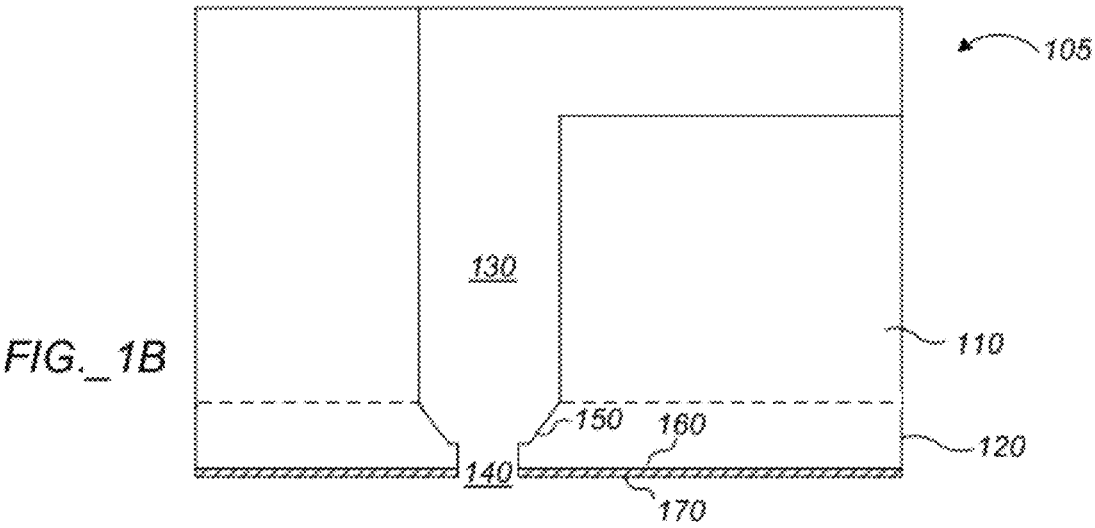
FIG. 1B is a cross-sectional view of an implementation of the fluid ejector of FIG. 1A with a non-wetting coating on an outer surface.
Figure 2:
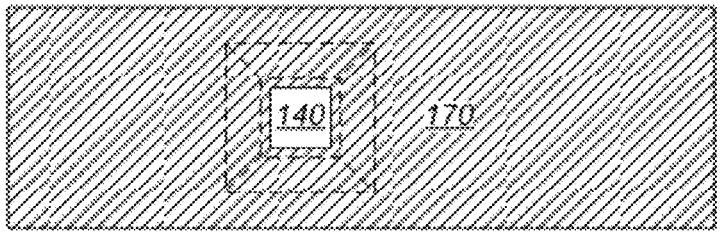
FIG. 2 is a bottom view of the fluid ejector from FIG. 1B.

As shown in FIG. 1B, a coated fluid ejector 105 can include a non-wetting coating 170 along the outer surface 160 of the fluid ejector. FIG. 2 shows a bottom view of the coated fluid ejector 105 having a non-wetting coating 170. The orifice 140 is shown as a rectangular opening, though other opening geometries may be suitable, such as circular or polygonal, such as a shape with five or more sides. The walls of the descender 130 and nozzle are shown in phantom.

Figure 3A:
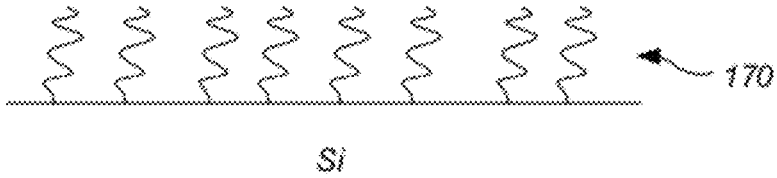
FIG. 3A is a schematic view of a non-wetting coating monolayer.
Figure 3B:
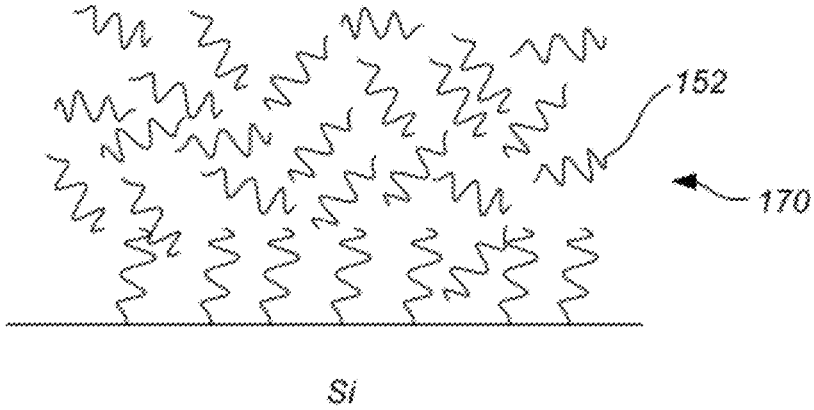
FIG. 3B is a schematic view of a non-wetting coating aggregation.

As illustrated by FIG. 3A, the non-wetting coating 170 can a self-assembled monolayer, i.e., a single molecular layer. Such a non-wetting coating monolayer 170 can have a thickness of about 5 to 30 Angstroms, such as about 10 to 20 Angstroms, e.g., about 15 Angstroms. Alternatively, as illustrated by FIG. 3B, the non-wetting coating 170 can be a molecular aggregation. In a molecular aggregation, the molecules 152 are separate but held in the aggregation by intermolecular forces, e.g., by hydrogen bonds and/or Van der Waals forces, rather than ionic or covalent chemical bonds. Such a non-wetting coating aggregation 170 can form in multiple layers, such as 2 layers, and can have an overall thickness of about 10 to 1000 Angstroms, such as 10 to 500 Angstroms, e.g. 30 to 50 angstroms. The increased thickness of the non-wetting coating make the non-wetting coating more durable and resistant to a wider range of fluids.

The molecules of the non-wetting coating can include one or more carbon chains terminated at one end with a $—CF_3$ group. The other end of the carbon chain can be terminated with a $SiCl_3$ group, or, if the molecule is bonded to a silicon oxide layer (not shown), terminated with a Si atom which is bonded to an oxygen atom of the silicon oxide layer (the remaining bonds of the Si atom can be filled with oxygen atoms that are connected in turn to the terminal Si atoms of adjacent non-wetting coating molecules, or with OH groups, or both.). The carbon chains can be fully saturated or partially unsaturated. For some of the carbon atoms in the chain, the hydrogen atoms can be replaced by fluorine. The number of carbons in the chain can be between 3 and 10. For example, the carbon chain could be $(CH_2)_M(CF_2)_NCF_3$, where $M \geqq 2$ and $N \geqq 0$, and $M+N \geqq 2$, e.g., $(CH_2)_2(CF_2)_7CF_3$.

Figure 3C:
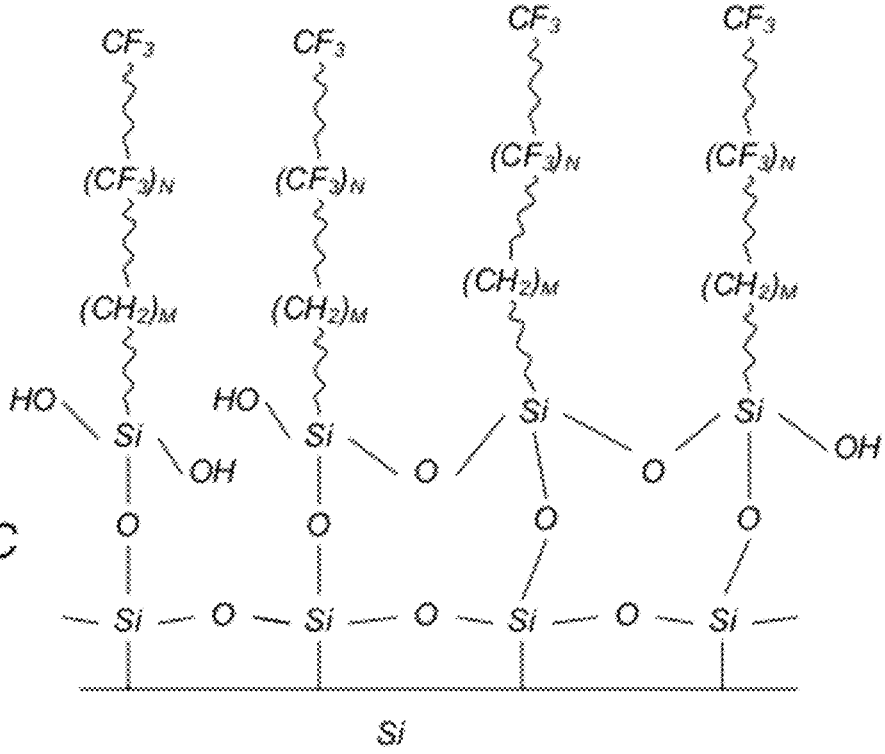
FIG. 3C is a schematic diagram of a chemical structure of an exemplary molecule of a non-wetting coating.

Referring to FIG. 3C, the molecules of the non-wetting coating adjacent the nozzle layer 120, i.e., the monolayer or the portion of the molecular aggregation adjacent the substrate, can be a siloxane that forms a bond with oxides formed near the surface of the nozzle layer or with OH groups on the surface of the nozzle layer 120, both of which can be enhanced by $O_2$ plasma treatment, as discussed further below.

Figure 4A:
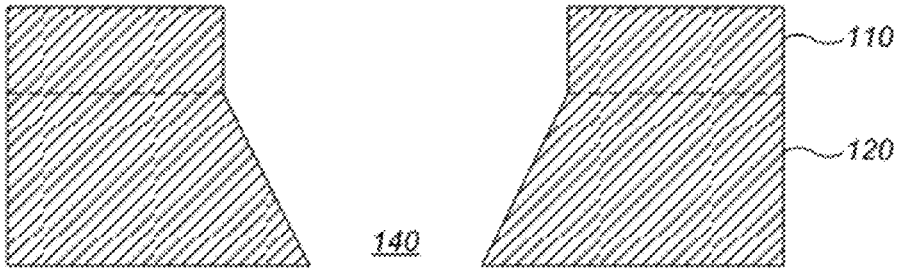
FIGS. 4A-4F illustrate an exemplary process for forming a fluid ejector.

A process for forming the non-wetting coating on a fluid ejector (e.g., an ink jet printhead nozzle) begins, as shown FIG. 4A, with a flow path module 110 having an uncoated nozzle layer 120. The flow path module 110 and nozzle layer 120 can be formed of single-crystal silicon. In some implementations, a native oxide layer, i.e., silicon oxide, having a thickness, for example, of up to about 40 Å, such as about 20 Å to 30 Å, is present on the surfaces of the fluid ejector. However, a native oxide layer tends to be less dense and may form weak bonds with a non-wetting coating. Thus, the native oxide can be partially or wholly removed, leaving either a very thin native oxide layer, e.g., less than 10 Å thick, or a surface that is formed of substantially pure silicon. The native oxide layer can have a density of less than 2.0 g/cm$^3$, such as 1.9 g/cm$^3$.

The fluid ejector can be subjected to oxygen ($O_2$) plasma treatment. The oxygen plasma treatment can be conducted, for example, in a plasma tool, such as anode coupling plasma tool, e.g. from Yield Engineering Systems, Livermore, Calif., or a cathode coupling plasma or inductively coupled plasma (ICP) tool. The fluid ejector can be placed in a vacuum chamber of the plasma tool and the pressure reduced to near vacuum, for example a pressure of less than 1 Torr, such as 0.2 Torr or $10^{-5}$ Torr. Oxygen can be introduced into the chamber, for example with a flow rate of 80 sccm. When RF power is initiated, such as at a power of 500 W, an $O_2$ plasma is formed. The $O_2$ plasma treatment can be conducted for between 1 minute and 90 minutes, such as 5 minutes to 60 minutes. Both the inner surface 150 and outer surfaces 160 of the fluid ejector can be exposed to the $O_2$ plasma.

Figure 4B:
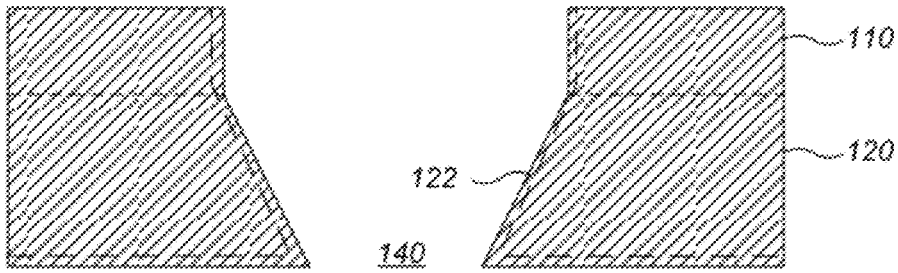

As shown in FIG. 4B, the $O_2$ plasma treatment can densify an outer portion 122 of the nozzle layer 120. For example, the $O_2$ plasma can cause $SiO_2$ to form along the outer portion of the nozzle layer 120 to densify the outer portion 122 (the densified outer portion 122 is shown in phantom). Further, the plasma can cause atoms from the walls of the chamber, such as aluminum atoms, to be removed from the walls and become embedded in the outer portion of the nozzle layer 120 to densify the outer portion 122. For example, $AlO_x$ can be embedded in the outer portion 122. The high density outer portion 122 can be between about 10 Å and 90 Å thick, such as between 20 Å and 80 Å thick, for example between 20 Å and 50 Å. Further, the high density outer portion 122 can have a density of greater than 2.5 g/cm$^3$, for example 2.6 g/cm$^3$, whereas the inner non-densified portions can have a density of less than 2.5 g/cm$^3$, such as between 2.0 g/cm$^3$ and 2.5 g/cm$^3$, for example 2.33 g/cm$^3$. Such a high density outer portion 122 provides more oxide with which the non-wetting layer can bond, increasing the physical robustness of the nonwetting layer and thereby making the layer more resistant to mechanical wiping of the nozzle surface. The density of the material can be determined using x-ray reflectivity (XRR).

In addition, the $O_2$ plasma treatment can increase the density of OH groups on the surface of the nozzle layer 120. Increasing the density of OH groups allows for good coverage of the non-wetting coating 170. That is, because the precursors for the non-wetting film bond with the OH groups on the nozzle layer 120, the greater density of OH groups allows for better coverage by the non-wetting coating 170. The higher percentage of OH groups can be verified using a time-of-flight secondary ion mass spectrometer (TOF-SIMS), such as one that uses $Ga^+$ ions to detect the OH groups. In some instances, the density of OH groups on an $O_2$ plasma treated surface is 1.5 to 2 times as great as the density of OH groups on a non-treated surface. The increased coverage of the non-wetting coating caused by the OH groups increases the chemical robustness of the nonwetting coating, thereby making it more difficult for jetting fluid to penetrate the coating. The coverage of the film can be determined by x-ray photoelectron spectroscopy (XPS).

Figure 4C:
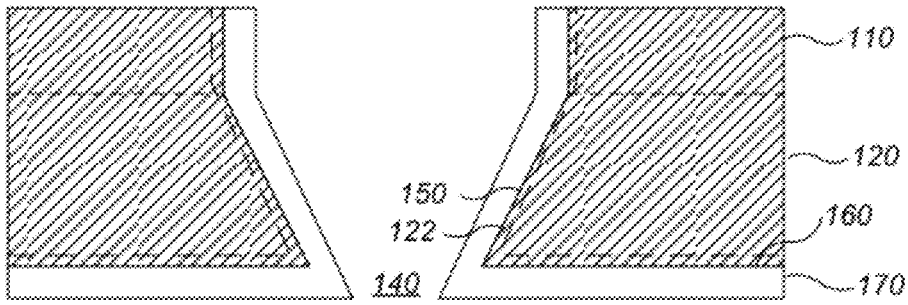

As shown in FIG. 4C, the non-wetting coating 170, e.g., a layer of hydrophobic material, is deposited on exposed surfaces of the fluid ejector, including both the outer surface 160 and the inner surface 150. The non-wetting coating 170 can be deposited using vapor deposition, rather than being brushed, rolled, or spun on.

The non-wetting coating 170 can be deposited, for example, by introducing a precursor and water vapor into a chemical vapor deposition (CVD) reactor at a low pressure. The partial pressure of the precursor can be between 0.05 and 1 Torr (e.g., 0.1 to 0.5 Torr), and the partial pressure of the $H_2O$ can be between 0.05 and 20 Torr (e.g., 0.1 to 2 Torr). The deposition temperature can be between room temperature and about 100 degrees centigrade. The coating process can be performed, by way of example, using a Molecular Vapor Deposition (MVD)™ machine from Applied MicroStructures, Inc., San Jose, Calif.

Suitable precursors for the non-wetting coating 170 include, by way of example, precursors containing molecules that include a terminus that is non-wetting, and a terminus that can attach to a surface of the fluid ejector. For example, precursor molecules that include a carbon chain terminated at one end with a —$CF_3$ group and at a second end with an —$SiCl_3$ group can be used. Specific examples of suitable precursors that attach to silicon surfaces include tridecafluoro-1,1,2,2-tetrahydrooctyltrichlorosilane (FOTS) and 1H,1H,2H,2H-perfluorodecyl-trichlorosilane (FDTS). Other examples of non-wetting coatings include 3,3,3-trifluoropropyltrichlorosilane ($CF_3(CH_2)_2SiCl_3$) and 3,3,3,4,4,5,5,6,6,-nonafluorohexyltrichlorosilane ($CF_3(CF_2)_3(CH_2)_2SiCl_3$). Without being limited by any particular theory, it is believed that when a precursor (such as FOTS or FDTS) whose molecules include an —$SiCl_3$ terminus are introduced into the CVD reactor with water vapor, the precursor undergoes hydrolysis, and then a siloxane bond is created so that silicon atoms from the —$SiCl_3$ groups bond with oxygen atoms from —OH groups on the surface of the nozzle layer 120, such as the OH groups of the native oxide of the nozzle layer 120, resulting in a coating, such as a monolayer, of molecules with the other, i.e. non-wetting, terminus exposed.

Figure 4D:
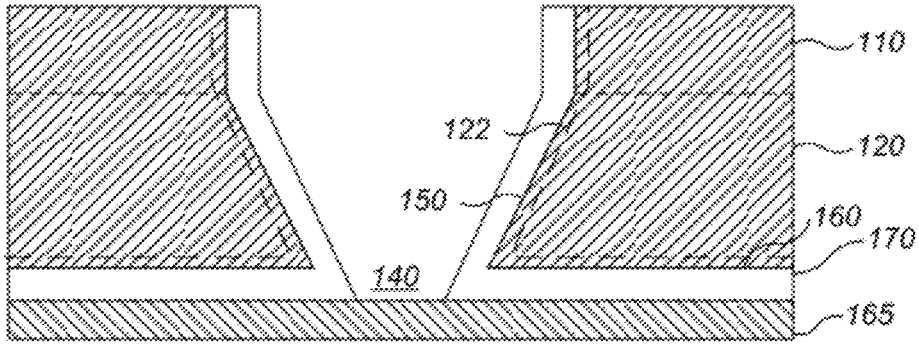

Referring to FIG. 4D, optionally, the non-wetting coating can be removed from the interior of the flow path. A mask 165 is applied to an outer surface of the fluid ejector, e.g., at least a region surrounding nozzle 140. The masking layer may be formed from various materials. For example, tape, wax, or photoresist can be used as a mask. The mask 165 protects the surface onto which it is applied from removal or damage resulting during a cleaning step (e.g. from exposure to oxygen plasma), and/or from subsequent deposition (e.g., from deposition of an overcoat layer). The mask 165 may have sufficiently low adhesion so that it may be removed without removing or damaging or otherwise materially altering non-wetting coating 170 beneath it.

Figure 4E:
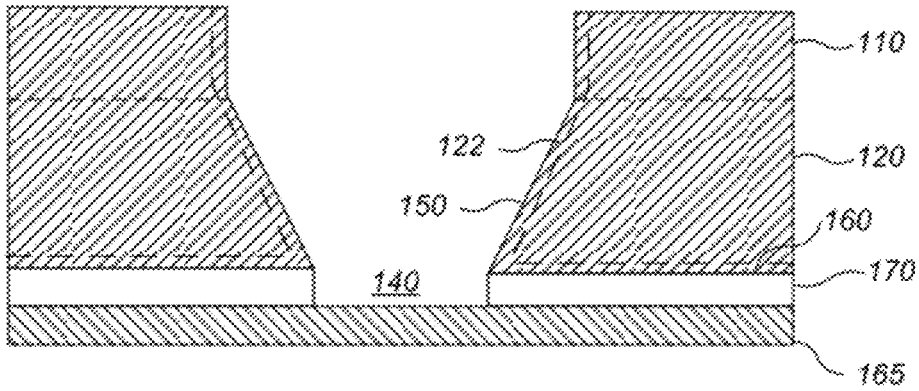

Referring to FIG. 4E, the interior surface 150 of the fluid ejector in the fluid path is subjected to a cleaning step, for example a cleaning gas, e.g., an oxygen plasma treatment, that removes a portion of the non-wetting coating that is not covered by the mask 165. The oxygen plasma can be applied to a substrate inside a chamber, or the source of oxygen plasma can be connected to the inlet of the fluid path. In the former case, the mask 165 prevents the oxygen plasma in the chamber on the outside of the fluid ejector from removing the non-wetting coating on the exterior surface. In the later case, the mask 165 prevents the oxygen plasma from escaping through the orifices (and in this case, the mask need only cover the orifices themselves) and removing the non-wetting coating on the exterior surface.

Figure 4F:
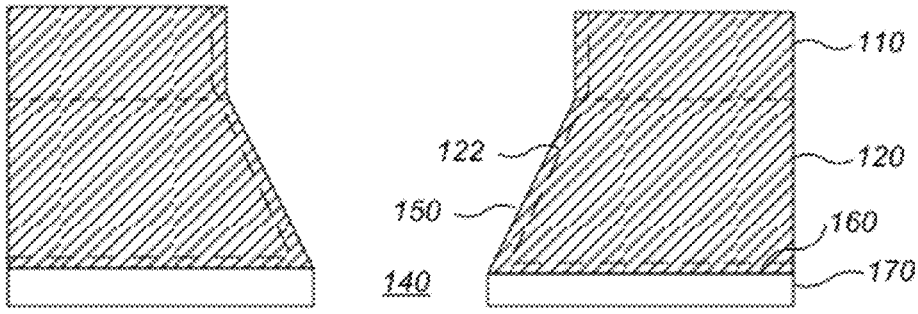

Referring to FIG. 4F, following the cleaning step, the mask 166 is removed to provide the fluid ejector as shown in FIG. 1B. The final completed device is a fluid ejector with a non-wetting layer 170 on the exterior surface 160 and an interior surface 150 that is more wetting than the non-wetting surface.

In another embodiment, the non-wetting coating 170 is deposited on the outer surface of the fluid ejector before the fluid-path module 110 and nozzle layer 120 are joined.

By bonding the non-wetting coating directly to the silicon nozzle layer, rather than using an adhesion layer, a more robust non-wetting coating can be formed. That is, an adhesion layer, such as $SiO_2$, $SiN_2$, $TiO_2$, or $Ta_2O_3$, is generally at least 100 nm thick, such as approximately 200 nm thick. If a small pinhole is created through the non-wetting coating, aggressive inks, such as EPSON ink, for example T054220 cyan ink, can attack the thick adhesion layer, resulting in the non-wetting coating delaminating from the substrate. However, if the non-wetting coating is bonded directly to the silicon nozzle layer, there is no adhesion layer for the aggressive inks to attack, reducing the risk of delamination. Moreover, even if a native oxide layer is present on the substrate, such a very thin layer will be more difficult for an aggressive ink to attack, and thus the nonwetting coating remains less likely to be removed from the substrate.

Particular embodiments have been described. Other embodiments are within the scope of the following claims.

What is claimed is:

1. A method of forming a non-wetting coating on a fluid ejector, comprising:

prior to depositing a non-wetting coating, applying an oxygen plasma to a silicon substrate to form an outer portion of the substrate having a density that is greater than a density of an interior portion of the substrate, the outer portion less than 80 Å thick; and after applying the oxygen plasma to form the outer portion of the substrate, depositing the non-wetting coating directly on an exterior surface of the outer portion formed by applying the oxygen plasma.

2. The method of claim 1, wherein the density of the outer portion is at least 2.5 g/cm$^3$.

3. The method of claim 2, wherein the density of the outer portion is approximately 2.6 g/cm$^3$.

4. The method of claim 1, wherein the density of the inner portion is between 2.0 g/cm$^3$ and 2.5 g/cm$^3$.

5. The method of claim 1, wherein the non-wetting coating is formed from a precursor vapor that includes at least one of tridecafluoro-1,1,2,2-tetrahydrooctyltrichlorosilane (FOTS) or 1H,1H,2H,2H-perfluorodecyltrichlorosilane (FDTS).

6. The method of claim 1, wherein the non-wetting coating is a self-assembled monolayer.

7. The method of claim 1, wherein the non-wetting coating is a molecular aggregation.

8. The method of claim 1, wherein the plasma is applied at a pressure of less than 1 Torr.

9. The method of claim 1, wherein the oxygen plasma is applied for 5 to 60 min.

10. The method of claim 1, wherein the oxygen plasma is applied using an anode coupling plasma tool.

11. The method of claim 10, wherein applying the oxygen plasma causes atoms from walls of a chamber of the coupling plasma tool to become embedded in the outer portion.

12. The method of claim 1, wherein the non-wetting coating is applied using chemical vapor deposition.

13. The method of claim 1, further comprising applying the oxygen plasma to an interior surface of a fluid path formed in the substrate and depositing the non-wetting coating on the interior surface.

14. The method of claim 13, further comprising removing the non-wetting coating from the interior surface.

15. The method of claim 14, further comprising masking the exterior surface while removing the non-wetting coating from the interior surface.

16. The method of claim 1, wherein applying the oxygen plasma comprises embedding aluminum in the outer portion.

17. A method of forming a non-wetting coating on a fluid ejector, comprising:

prior to depositing a non-wetting coating, applying an oxygen plasma to a substrate to form an outer portion of the substrate having a density that is greater than a density of an interior portion of the substrate, the outer portion less than 80 Å thick; and after applying the oxygen plasma to form the outer portion of the substrate, depositing the non-wetting coating on an exterior surface of the outer portion, wherein the non-wetting coating is a self-assembled monolayer, and wherein the non-wetting coating is between 5 Å and 30 Å thick.

18. The method of claim 17, wherein the non-wetting coating is between 10 Å and 20 Å thick.

19. A method of forming a non-wetting coating on a fluid ejector, comprising:

prior to depositing a non-wetting coating, applying an oxygen plasma to a substrate to form an outer portion of the substrate having a density that is greater than a density of an interior portion of the substrate, the outer portion less than 80 Å thick; and after applying the oxygen plasma to form the outer portion of the substrate, depositing the non-wetting coating on an exterior surface of the outer portion, wherein the non-wetting coating is a molecular aggregation, and wherein the non-wetting coating is between 10 Å and 1,000 Å thick.

* * * * *